US006547584B2

(12) United States Patent
Myer et al.

(10) Patent No.: US 6,547,584 B2
(45) Date of Patent: Apr. 15, 2003

(54) CONNECTOR POSITION ASSURANCE DEVICE FOR A SEALED CONNECTOR

(76) Inventors: John Mark Myer, 397 Walnut Hill Rd., Millersville, PA (US) 17551; John Richard Shuey, 1255 Jerusalem Rd., Mechanicsburg, PA (US) 17055

( * ) Notice: Subject to any disclaimer, the term of this patent is extended or adjusted under 35 U.S.C. 154(b) by 0 days.

(21) Appl. No.: 09/785,369

(22) Filed: Feb. 16, 2001

(65) Prior Publication Data

US 2002/0115332 A1 Aug. 22, 2002

(51) Int. Cl.[7] ..... H01R 13/627
(52) U.S. Cl. ..... 439/352; 439/271
(58) Field of Search ..... 439/352, 271, 439/488, 272, 489

(56) References Cited

U.S. PATENT DOCUMENTS

| | | | | |
|---|---|---|---|---|
| 5,605,472 A | * | 2/1997 | Sakai et al. | 439/489 |
| 5,643,003 A | | 7/1997 | Myer et al. | |
| 5,651,689 A | | 7/1997 | Flyer et al. | 439/352 |
| 6,004,153 A | | 12/1999 | Myer et al. | 439/352 |

OTHER PUBLICATIONS

U.S. patent application Ser. No. 09/780,296, Raudenbush et al., filed Feb. 9, 2001.

U.S. patent application Ser. No. 09/752,789, Marpo, Jr. et al., filed Dec. 28, 2000.

* cited by examiner

*Primary Examiner*—Khiem Nguyen

(57) ABSTRACT

A sealed electrical connector assembly is provided having a connector position assurance device (CPA) including at least one CPA support rail and a CPA latch finger. A plug housing is provided with a body section having a mating interface on one end thereof that retains a plurality of plug contacts. The plug housing includes a shroud extending about at least a portion of the body section and is spaced apart from the body section by a predefined gap. A header is provided having a base retaining a plurality of header contacts adapted to electrically engage the plug contacts. The header includes walls defining a plug receptacle adapted for receiving the mating interface. The walls are received in the gap between the shroud and the body section of the plug housing. A seal is mounted to one of the plug housing end header to form a hermetic seal between the plug housing and header when fully mated with one another. A CPA retention assembly is mounted to at least one of the plug housing and header. The CPA is slidably mounted to the CPA retention assembly and moveable between a retracted position and a locked position. The CPA permits engagement and disengagement of the header and plug when in the CPA retracted position and prevents engagement and disengagement of the header plug assembly when in the CPA locked position.

31 Claims, 7 Drawing Sheets

CONNECTOR POSITION ASSURANCE DEVICE FOR A SEALED CONNECTOR

BACKGROUND OF THE INVENTION

The preferred embodiments of the present invention generally relate to a sealed electrical connector assembly that includes a connector position assurance device (CPA) for assuring that matable connectable halves, such as a header and plug, are fully mated with one another.

Connector devices have been proposed that provide electrical terminals having matable male to female connector halves. One of the male and female connector halves includes a resilient, extended lock arm that locks behind a bar on the complementary connector half. When the connector halves are mated, a CPA and an assist device are inserted along a track. The CPA includes resilient, releasable lock tabs to retain it in engagement with the connectors. The CPA device provides a means to assure that the male and female connectors are fully mated.

U.S. Pat. No. 5,643,003 discloses a connector assembly including a plug housing and a header. The plug housing includes a housing latch formed thereon that includes grooves for slidably receiving a connector position assurance device (CPA). The CPA is inserted from a mating side face of the plug housing and is movable from a first position to a final position only when the header is filly mated to the plug housing. The CPA includes a deflectable beam and an embossment. The beam is deflected below projections of a latch on the header as the CPA is moved into its final position. When the CPA is in its final position, the operator can readily observe that the plug housing has been fully mated to the header. Additionally, a deflecting force which, when applied to the header latch, causes the header latch to deflect relative to the receptacle housing. The deflecting force will also cause the CPA to be displaced relative to the plug housing when the CPA is in the first position.

However, the connector assembly of the '003 patent is not readily adaptable to electrical connectors that require a seal or utilize shrouds. For example, the header latch of the '003 patent extends through the area that otherwise would be used for sealing, and prevents adequate sealing.

It is a n object of at least one preferred embodiment of the present invention to overcome the above-noted and other disadvantages of conventional connectors.

BRIEF SUMMARY OF THE INVENTION

At least one preferred embodiment of the present invention is provided including a sealed electrical connector assembly having a connector position assurance device (CPA) including at least one CPA support rail and a CPA latch finger. The plug housing includes a body section with a mating interface on one end thereof. The mating interface retains a plurality of plug contacts. The plug housing further includes a shroud extending about at least a portion of the body section. The shroud is spaced apart from the body section by a gap. A header includes a base retaining a plurality of header contacts adapted to electrically engage the plug contacts. The header includes walls that define a plug receptacle adapted for receiving the mating interface. The walls are received in the gap between the shroud and body section of the plug housing. A seal is mounted to one of the plug housing and header to form a hermetic seal between the plug housing and header when the plug housing and header are fully mated with one another. The electrical connector assembly further includes a CPA retention assembly mounted to at least one of the plug housing and header. The CPA is slidably mounted to the CPA retention assembly and movable between a retracted position and a locked position. The CPA permits engagement and disengagement of the header and plug housing when in the retracted position and prevents engagement and disengagement of the header and plug assembly when in the locked position.

In accordance with at least one alternative embodiment, the CPA further comprises at least one rail support having a groove therein and the CPA latch assembly comprises at least one rail slidably received within the groove to guide the CPA between the retracted and locked positions.

In accordance with at least one alternative embodiment, the shroud surrounds a perimeter of the plug housing to define a peripheral gap about the seal. The gap accepts top, bottom and sidewalls of the header to form a hermetic seal between the body section and the header . The header includes a CPA reset embossment on one wall which engages the CPA, and resets it to the retracted position, when the CPA is in the locked position before the plug housing and header are fully mated with one another.

In accordance with at least one alternative embodiment, the plug housing includes top, bottom and sidewalls defining the mating interface of the body section, while the header comprises top, bottom and sidewalls defining the opening. The walls of the plug housing and header form a hermetic contact with the seal when the header and plug housing are fully mated.

Optionally, the CPA retention assembly may be mounted to the shroud. As a further option, a deflectable latch beam may be mounted at an intermediate point along the latch beam to the plug housing. The header may include a latch mating element that engages one end of the latch beam when the plug housing and header are fully mated.

Optionally, the seal may be mounted to a perimeter of the body section of the plug housing and walls of the header may cooperate with the seal to form a sealed interface with the body section when fully mated. Optionally, the CPA retention assembly may include a header rail and a latch rail. The header rail may be mounted to a wall of the header and the latch rail may be mounted to the shroud. The header rail and latch rail are aligned when the housing plug and header are fully mated to permit the CPA to move from the retracted position to the locked position.

In accordance with at least one alternative embodiment of the present invention, an electrical connector is provided comprising a connector position assurance device (CPA) having a CPA guideway and a CPA retention lever. A first connector housing and a second connector housing are provided having first and second connector interfaces, respectively, containing contacts that are joined when the first and second connectors are mated with one another. A latch assembly is provided having a first latch guideway adapted to slidably join the CPA guideway to permit the CPA to be moved from a retracted position to a locked position. The latch assembly further includes a latch engagement surface. A latch mating element may be located on one of the first and second connector housings to securely engage the latch engaging surface of the latch assembly when the first and second housings are fully mated. The latch mating element may include a second latch guideway adapted to slidably join the CPA guideway to retain the CPA in its retracted position. A seal is mounted to on e of the first and second connector housings to for m a hermetic seal between the first and second connector housings when fully mated.

In accordance with at least one alternative embodiment, a shroud is mounted to the first connector housing and arranged to surround the second connector housing when the first and second connector housings are fully mated. Optionally, the first and second latch guideways may include rails and the CPA guideway may include a groove that accepts the rails. Optionally, the first and second connector housings may each include top, bottom and sidewalls defining the first and second connector interfaces that are hermetically sealed to one another by the seal when fully mated. Optionally, the latch assembly may be formed on a shroud surround the first and connector housing.

Figure 1:
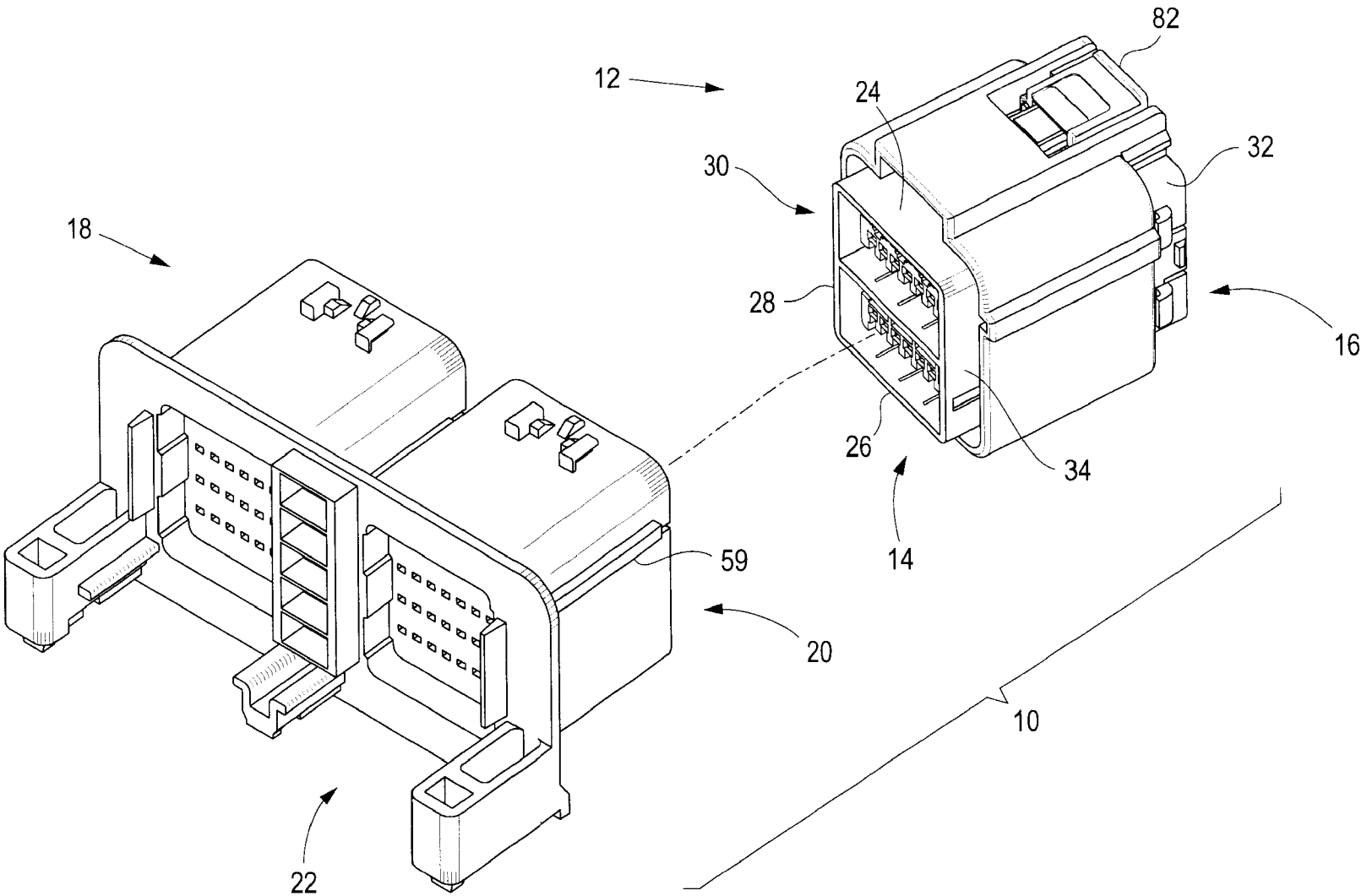
FIG. 1 illustrates an isometric view of a sealed electrical connector housing assembly formed in accordance with a preferred embodiment of the present invention.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

FIG. 1 illustrates an isometric view of a sealed electrical connector housing assembly 10 that comprises first and second housings. In the illustrated embodiment of FIG. 1, these two housings are a plug housing 12 and a header 18. The plug housing 12 comprises a front end 14 and a rear end 16. The rear end 16 receives wires (not shown). The header 18 includes front end 20 and rear end 22. The front end 14 of the plug housing 12 mates with the front end 20 of the header 18. The rear end 22 of the header 18 receives a grid of wires arranged in rows and columns. The wires may be bent at a 90° angle downward to be connected to another element (not shown).

Figure 3:
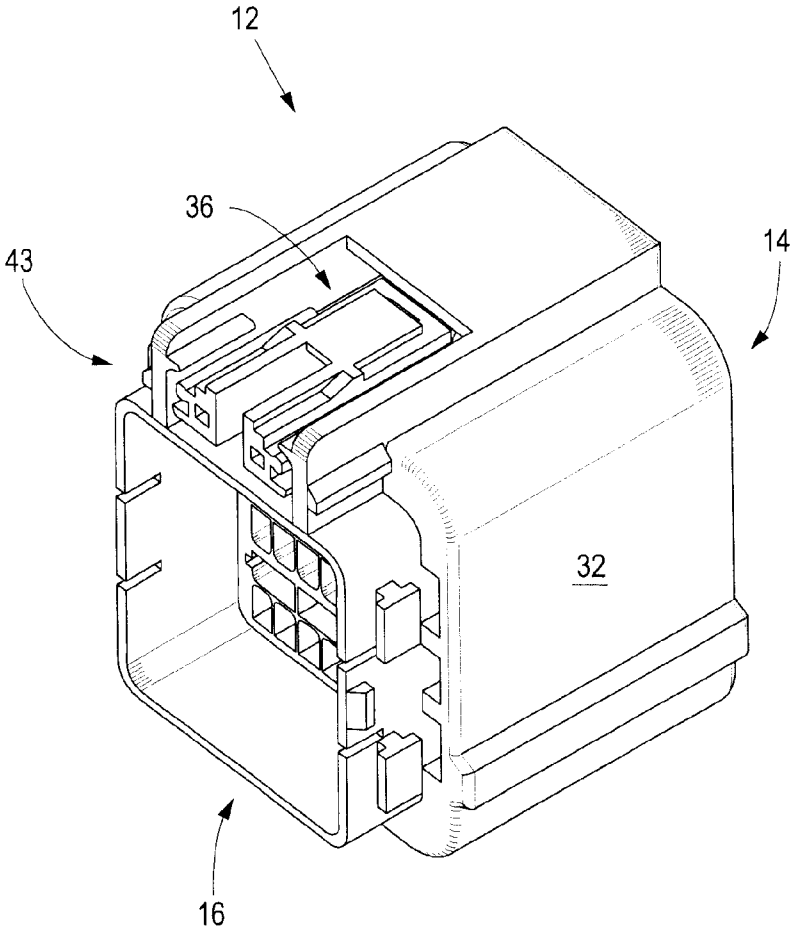
FIG. 3 illustrates an isometric rear view of a plug housing formed in accordance with a preferred embodiment of the present invention.
Figure 2:
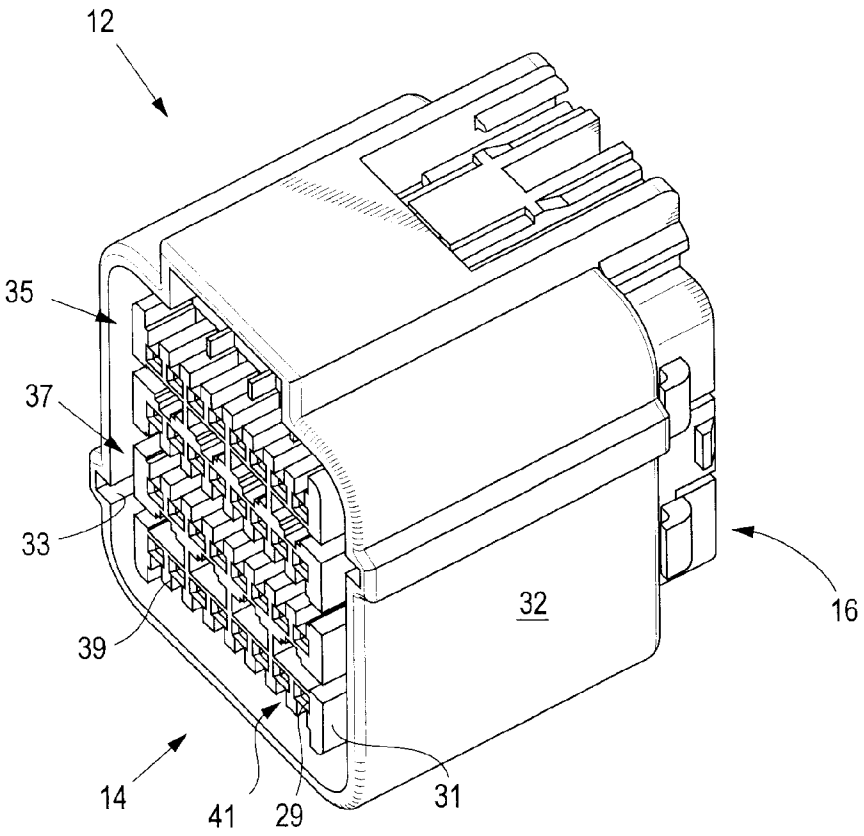
FIG. 2 illustrates an isometric front view of a plug housing formed in accordance with a preferred embodiment of the present invention.
Figure 6:
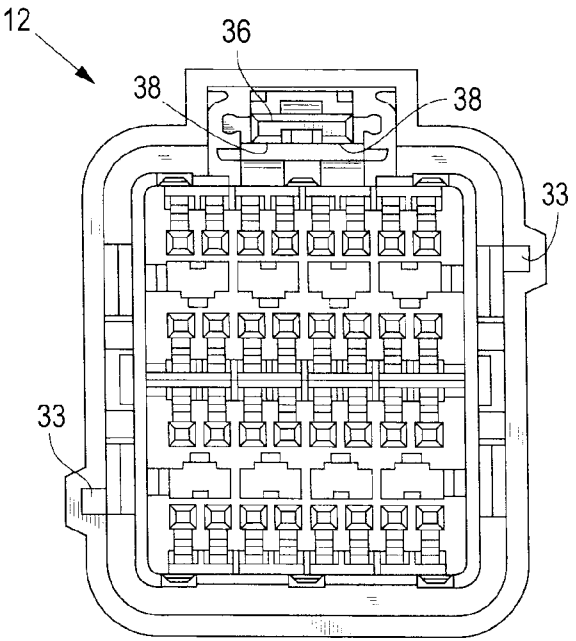
FIG. 6 illustrates a front view of a plug housing formed in accordance with a preferred embodiment of the present invention.
Figure 5:
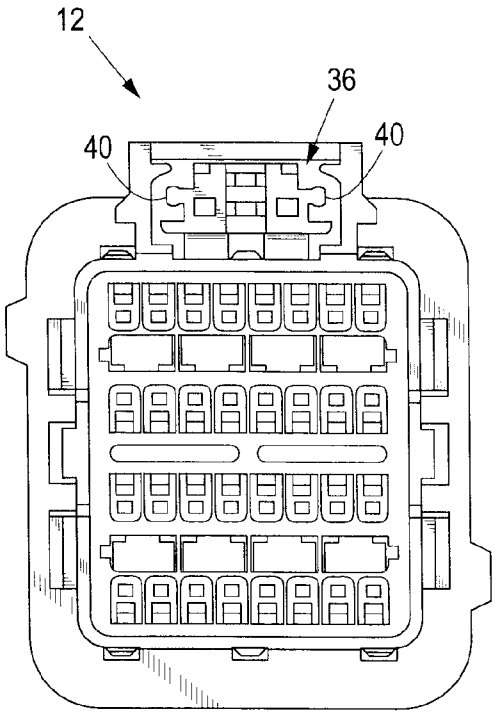
FIG. 5 illustrates a rear view of a plug housing formed in accordance with a preferred embodiment of the present invention.
Figure 4:
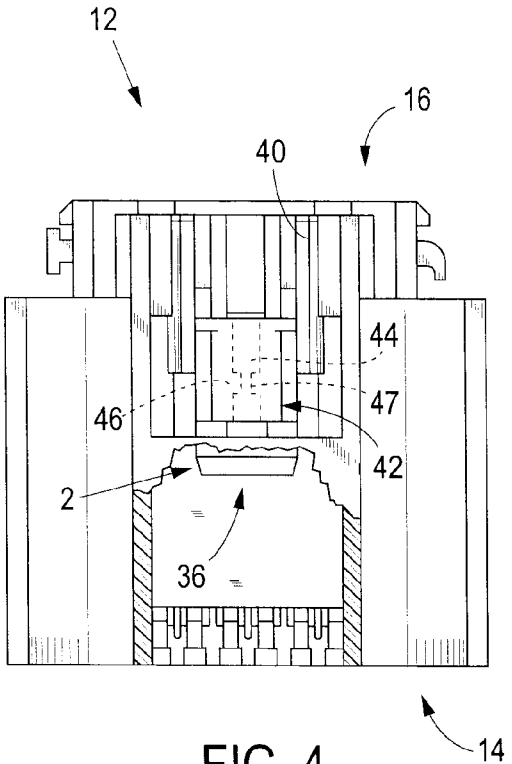
FIG. 4 illustrates a top plan view of a plug housing formed in accordance with a preferred embodiment of the present invention.

FIGS. 2 and 3 illustrate front and rear isometric views of the plug housing 12. FIG. 4 illustrates a plan view of the plug housing 12, FIG. 5 illustrates a rear view, and FIG. 6 illustrates a front view of the plug housing 12. The plug housing 12 includes a shroud 32 surrounding an internal body section 31. The body section 31 includes a mating interface 30 having a plurality of apertures 29 therein arranged in rows and columns. Each aperture retains a plug contact 39 that is connected at one end to wires (not shown) leading from the rear end 16. In the embodiment of FIG. 1, the internal body section 31 is divided into upper and lower portions 35 and 37, each of which retains at least one row of contacts 39 in apertures 29. The internal body section 31 includes a top wall 24, bottom wall 26 and sidewalls 28. The outer peripheral surface of the internal body section 31 is spaced a distance 41 from the interior surface of the shroud 32. The outer peripheral surface of the top wall 24, bottom wall 26 and sidewalls 28 of the internal body section 31 is enclosed by a rubber seal 34. The seal 34 frictionally engages an interior surface of the header 18 to form a hermetic seal between the peripheral surface of the internal body section 31 and the interior of the header 18.

The shroud 32 may include one or more grooves 33 extending from the front end 14 along the interior surface of the shroud 32. The grooves 33 receive corresponding ribs 59 located on the exterior walls of the header 18. The grooves 33 and ribs 59 cooperate to ensure proper orientation between the plug housing 12 and header 18 before mating.

A latch assembly 43 fastens the plug housing 12 and header 18 when mated to one another. The latch assembly 43 comprises a deflectable latch beam 36 mounted to the shroud 32 at a point proximate the center of the latch beam 36 through a vertical post extending upward from the shroud 32. The deflectable latch beam 36 is normally biased in a substantially horizontal position. However, the deflectable latch beam 36 may be deflected under an imposed force in either direction in a "see-saw" manner. The deflectable latch beam 36 is composed of a resilient material such that it will return to substantially its original position once the imposed force is removed. A latch engaging surface 38 is located on the underside of the front portion 37 of the deflectable latch beam 36. The latch engaging surface 38 includes a ramped portion 48, a flat portion 49, and a latching portion 50, best seen in FIG. 17. The deflectable latch beam 36 also comprises a latch rail 40 extending along the side of the deflectable latch beam 36. The latch rail 40 is configured for slidable contact with the rail surface 88 of the CPA 82. The illustrated embodiment comprises two latch engaging surfaces 38 and two latch rails 40. Preferably, a finger stop 42 is also included on the deflectable latch beam 36. The finger stop is located proximate the center of the deflectable latch beam. The deflectable latch beam 36 may further comprise a stopping portion 41 located proximate and interior to the latch rails 40, best seen in FIG. 17. The embodiment illustrated features a finger stop 42 comprising a channel 44 and ears 46. The channel 44 extends down the center of the deflectable latch beam 36, with two ears 46 opposing each other on opposite sides of the channel 44.

Figure 8:
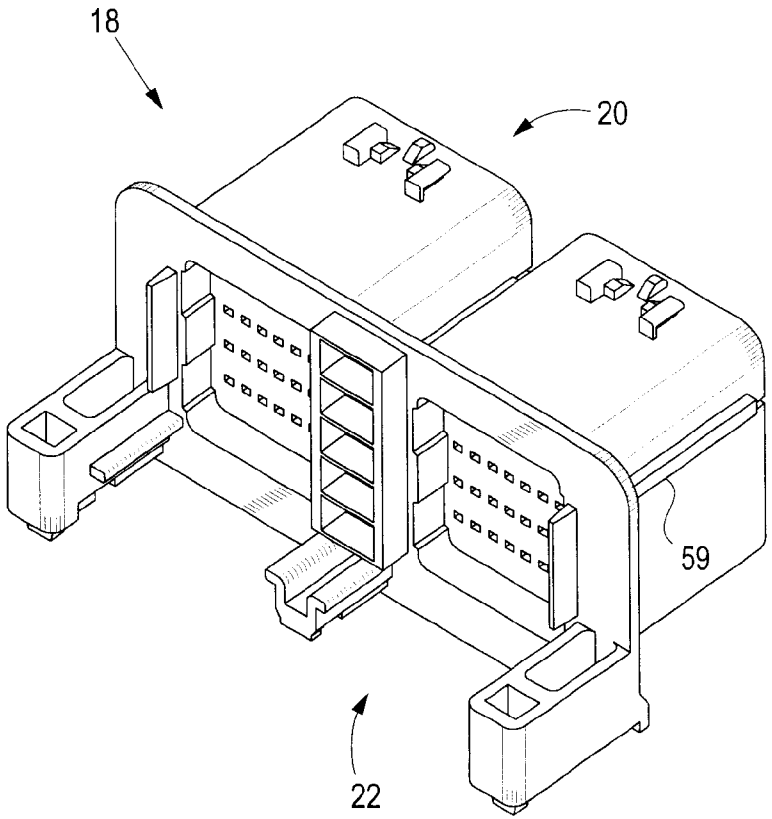
FIG. 8 illustrates an isometric rear view of a header formed in accordance with a preferred embodiment of the present invention.
Figure 7:
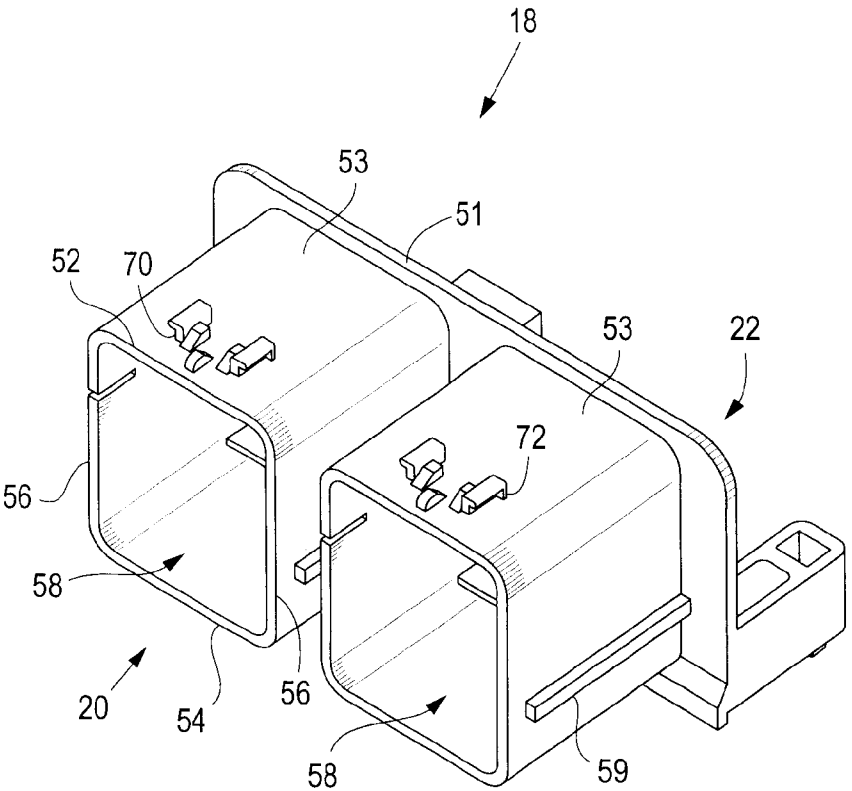
FIG. 7 illustrates an isometric front view of a header formed in accordance with a preferred embodiment of the present invention.

FIGS. 7 and 8 illustrate isometric views of the header 18. The header 18 has an opening 58 configured to receive the mating interface 30 of the plug housing 12. The illustrated header features two openings 58. The header 18 includes a base plate 51 with a pair of hollow receptacles 53 formed on one side thereof. Each receptacle 53 includes a top wall 52, bottom wall 54 and sidewalls 56. The top wall 52, bottom wall 54, and sidewalls 56 define the opening 58. Preferably, the header 18 may include one or more ribs 59 located along the outside of one or more of top wall 52, bottom wall 54 and sidewalls 56. The ribs 59 are located and configured to be accepted by grooves 33 of the plug housing 12 to insure proper alignment of the plug housing 12 and header 18 when they are brought together for mating. In the illustrated embodiment, two ribs 59 on opposite sidewalls 56 cooperate with two grooves 33 located on the shroud 32 for alignment purposes. The location of grooves 33 and ribs 59 can also be varied for similarly sized connector assemblies to prevent connecting a plug housing to an incorrect header.

Figure 11:
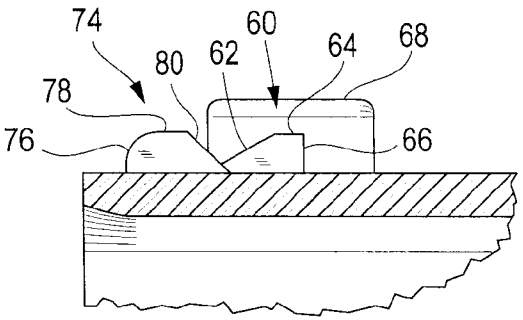
FIG. 11 illustrates a sectional view of a cut-out portion of a header taken along line 11—11 in FIG. 9 formed in accordance with a preferred embodiment of the present invention.
Figure 10:
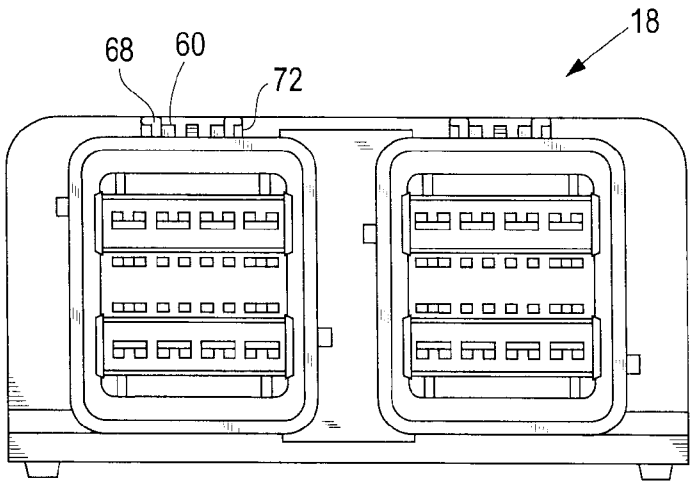
FIG. 10 illustrates a front view of a header formed in accordance with a preferred embodiment of the present invention.
Figure 9:
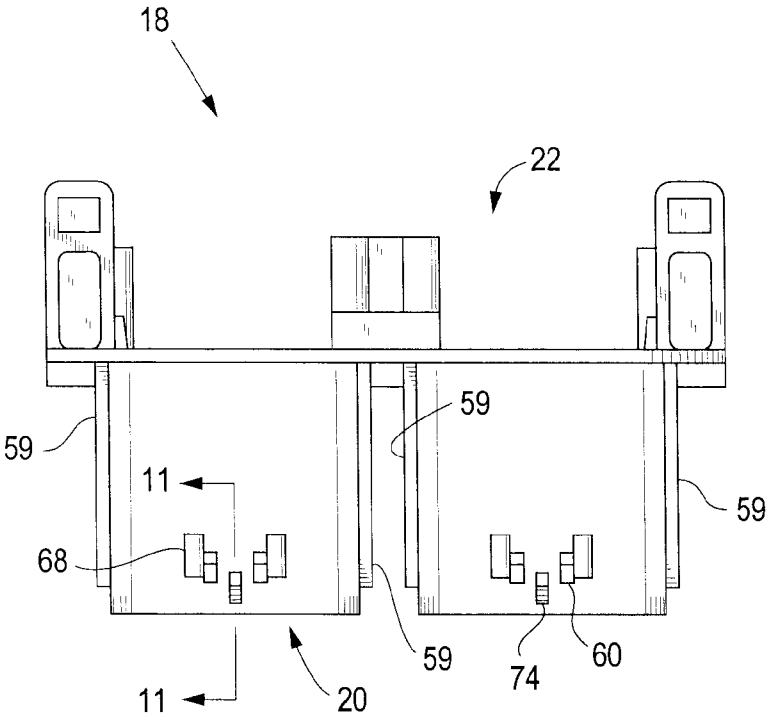
FIG. 9 illustrates a top plan view of a header formed in accordance with a preferred embodiment of the present invention.

FIG. 9 illustrates a plan view of the header 18, while FIG. 10 illustrates a front view and FIG. 11 illustrates a sectional view of the header 18. The header 18 includes a latch mating element 60 located on one or more of the walls 52, 54 and 56. The latch mating element 60 of the illustrated embodiment in turn comprises a ramped surface 62, a flat portion 64, and a vertical portion 66. The ramped surface 62 inclines from the front end 20 to the rear end 22 of the header 18. The flat portion 64 is substantially horizontal, and the vertical portion 66 is substantially vertical and located proximate the rear end 22. The latch mating element 60 cooperates with the latch engaging surface 38 of the deflectable latch beam 36 in the illustrated embodiment to secure the plug housing 12 and header 18 when properly mated. The following sequence of events occurs as the plug housing 12 and header 18 are urged together.

As the plug housing 12 and header 18 are brought together, the internal body section 31 is received in the opening 58 with the walls 52, 54 and 56 fit between the body section 31 and shroud 32. The grooves 33 and ribs 59 cooperate to assure proper alignment. As the plug housing 12 and header 18 are further urged together, the latch engaging surface 38 comes into contact with the latch mating element 60. More specifically, the ramped portion 48 of the latch engaging surface 38 comes into contact with the ramped surface 62 of the latch mating element 60. Upon further urging, the ramped portion 48 and ramped surface 62 begin to slide along each other. This motion causes the front portion 37 of the deflectable latch beam 36 to articulate upward from its original substantially horizontal position. As the ramped portion 48 and ramped surface 62 slide further along each other, the deflectable latch beam 36 is further deflected. As the plug housing 12 and header 18 are urged further still together, the flat portion 49 of the deflectable latch beam 36 begins to slide along the flat portion 64 of the latch mating element 60.

Eventually, the trailing edge of the flat portion 49 of the deflectable latch beam 36 slides off the flat portion 64 of the latch mating element 60. At this point, there is no longer a normal force deflecting the deflectable latch beam 36. Consequently, the deflectable latch beam 36 snaps back to its original substantially horizontal position. With the deflectable latch beam 36 once again substantially horizontal, the latching portion 50 of the deflectable latch beam 36 and the vertical portion 66 of the latch mating element 60 cooperate to provide a positive mechanical stop preventing the separation of the now mated plug housing 12 and header 18. Thus secured, the plug housing 12 and header 18 may only be separated by accidental or coincidental manual deflection of the deflectable latch beam 36 (such as by an operator's thumb pressing down on the deflectable latch beam 36 near the rear end 16 of the plug housing) and urging apart of the plug housing 12 and header 18.

The header 18 also comprises a header rail 68 extending lengthwise along the top of the header 18, offset from the center of the header 18. The header rail 68 is configured for slidable contact with the rail surface 88 of the CPA 82. Viewed from the front end 20 of the header 18, the header rail 68 appears similar to an upside-down "L". The header rail 68 includes an interior surface 70 and a stop 72.

The header 18 also comprises a header bump 74 located proximate the center of the top of the front end 20 of the header 18. The header bump 74 of the illustrated embodiment comprises a front ramped portion 76, a flat portion 78, and a rear ramped portion 80. The header bump 74 cooperates with the finger 96 of the CPA 82 to help maintain the CPA in position, and also serves to deflect the finger 96 to free the finger 96 from the finger stop 42.

Figure 13:
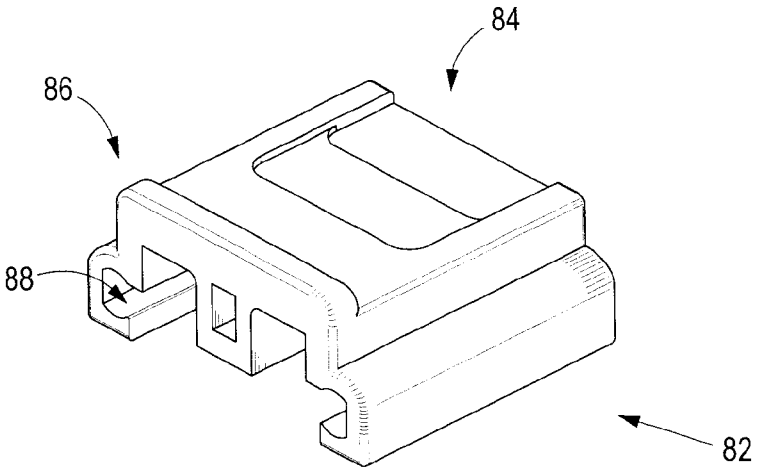
FIG. 13 illustrates an isometric rear view of a CPA formed in accordance with a preferred embodiment of the present invention.
Figure 15:
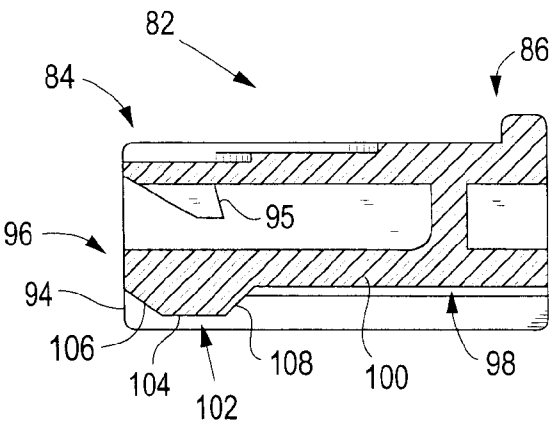
FIG. 15 illustrates a sectional view taken along line 15—15 in FIG. 12 of a CPA formed in accordance with a preferred embodiment of the present invention.
Figure 12:
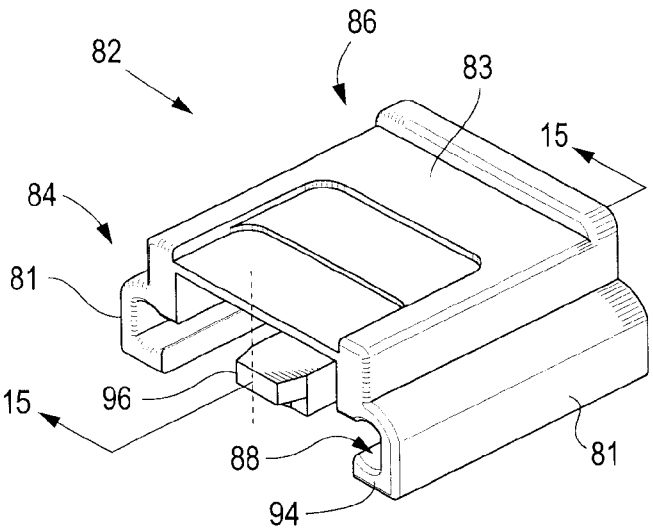
FIG. 12 illustrates an isometric front view of a connector position assurance device (CPA) formed in accordance with a preferred embodiment of the present invention.
Figure 14:
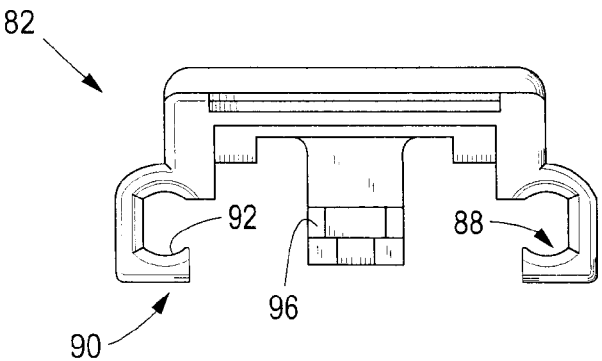
FIG. 14 illustrates a front view of a CPA formed in accordance with a preferred embodiment of the present invention.

FIGS. 12 and 13 illustrate isometric views of the connector position assurance device (CPA) 82. The CPA comprises a front portion 84 and a rear portion 86, as well as a top portion 83. FIG. 14 illustrates a front view of the CPA 82 and FIG. 15 illustrates a sectional view of the CPA 82. The top portion 83 of the CPA 82 includes rail sections 81 projecting along either side thereof. The rail section 81 include inner grooved rail surfaces 88 aligned to face one another and to extend along a length of the rail sections 81. The rail sections 81 include open front and rear ends proximate the front and rear portions 84 and 86. By way of example only, the rail section 81 and rail surfaces 88 may be formed in a C-shape. The rail surface 88 is configured for slidable contact with the latch rail 40 and header rail 68. A bottom leg 90 is included in each "C" shape and comprises an interior surface 92 and a face 94 proximate the front portion 84. Preferably, the CPA 82 also includes a stopping portion 95 mounted to and projecting down from the top portion 83. The stopping portion 95 is configured to engage stopping portion 41 of deflectable latch beam 36 to prevent the CPA 82 from sliding out of the rear end 16 of the plug housing 12 once inserted to an initial, prestage position.

The CPA 82 further comprises a finger 96 located between the rail sections 88 and projecting downward from the bottom surface of the top portion 83. The finger 96 comprises a base 98 mounted to the bottom surface of the top portion 83 and a cantilever beam 100 extending toward the front portion 84. Finger 96 is normally biased in a substantially horizontal position. An embossment 102 is located near the end of the cantilever beam 100 and on its underside. The embossment 102 includes a flat portion 104, a front ramped portion 106, and a rear ramped portion 108. The flat portion 104 is substantially as wide as the cantilever beam 100, whereas the front ramped portion 106 and rear ramped portion 108 are narrower than the cantilever beam 100. Both the front ramped portion 106 and rear ramped portion 108 slope from the base of the cantilever beam 100 to the edge of the flat portion 104. The finger 96 cooperates with the finger stop 42 to maintain the CPA 82 in its retracted position 110 when the plug housing 12 and header 18 are not mated. Once the plug housing 12 and header 18 are mated and the CPA 82 has been advanced to its locked position 112, the finger 96 cooperates with the header bump 74 to help maintain the CPA 82 in its locked position 112.

Figure 18:
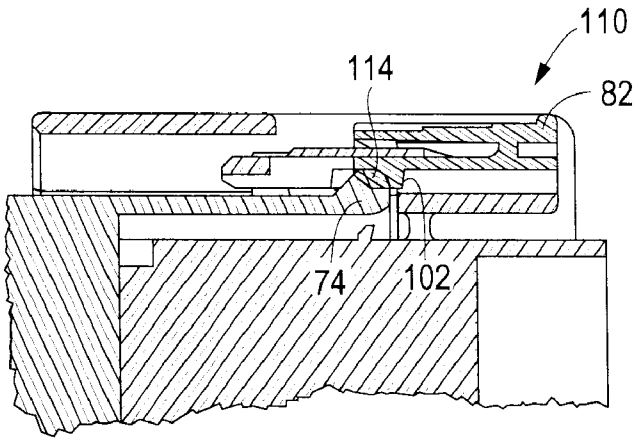
FIG. 18 illustrates a sectional view of a sealed electrical connector assembly with a CPA in the retracted position formed in accordance with a preferred embodiment of the present invention.
Figure 19:
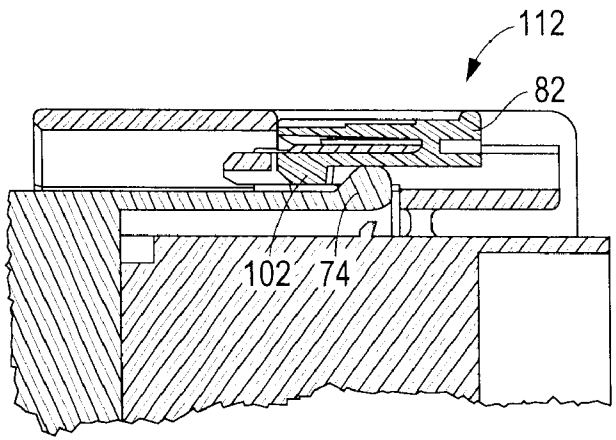
FIG. 19 illustrates a sectional view of a sealed electrical connector assembly with a CPA in the locked position formed in accordance with a preferred embodiment of the present invention.
Figure 16:
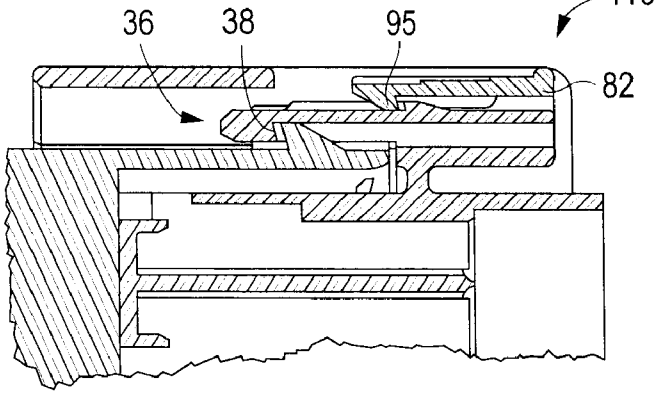
FIG. 16 illustrates a sectional view of a sealed electrical connector assembly with a CPA in the retracted position formed in accordance with a preferred embodiment of the present invention.
Figure 17:
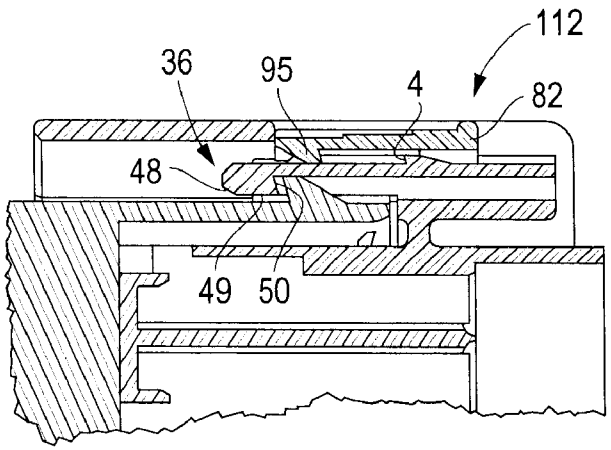
FIG. 17 illustrates a sectional view of a sealed electrical connector assembly with a CPA in the locked position formed in accordance with a preferred embodiment of the present invention.

FIGS. 16 and 18 illustrate sectional views of the sealed electrical connector assembly 10 with the CPA 82 in the retracted position 110. FIGS. 17 and 19 illustrate sectional views of the sealed electrical connector assembly 10 with the CPA 82 in the locked position 112. As described above, the plug housing 12 and header 18 once mated may only be separated by a coincident manual deflection of the deflectable latch beam 36 and urging apart of the plug housing 12 and header 18. The CPA 82 in the locked position 112 restrains the deflectable latch beam 36 from deflecting, thereby preventing separation of the mated plug housing 12 and header 18. When the CPA 82 is in the retracted position 110, the deflectable latch beam 36 may be deflected vertically until the latch engaging surface 38 disengages the vertical portion 66 of the latch mating element 60. Thereafter the plug housing 12 and header 18 may be separated.

When the CPA 82 is in the locked position 112 (FIGS. 17 and 19), the rail surface 88 is slidably engaged with the header rail 68. Any attempted articulation upward by the front portion 37 of the deflectable latch beam 36 is met and prevented by the top portion 83 of the CPA 82. Thus, for the deflectable latch beam 36 to deflect and allow separation of the plug housing 12 and header 18, the CPA 82 must be free to move upward. However, the CPA 82 may not move upward when in the locked position 112, as any such attempted movement is prevented by the interior surface 70 of the header rail 68 constraining the interior surface 92 of the bottom leg 90 of the rail surface 88 of the CPA 82. When the CPA 82 is moved relatively from the front end 14 of the plug housing 12 to the rear end 16 and into its retracted position 110, the CPA 82 slides free of the header rail 68, and the interior surface 70 no longer constrains the upward movement of the CPA 82. Thus, the deflectable latch beam 36 may be deflected and the plug housing 12 and header 18 separated from each other with the CPA 82 in the retracted position 110.

For proper mating, the CPA 82 is preferably maintained in its retracted position 110 as the plug housing 12 and header 18 are urged toward each other. In the illustrated embodiment, the deflectable latch beam 36 comprises a finger stop 42 to help keep the CPA 82 in its retracted position 110 when the plug housing 12 and header 18 are not mated. The finger stop 42 comprises a channel 44 with ears 46. The ears 46 define a gap 47. Further, the finger 96 comprises an embossment 102 with a flat portion 104. With the finger 96 in its normal substantially horizontal position, the flat portion 104 of the embossment 102 resides at least partially at the same elevation as the channel 44 and ears 46. The width of the flat portion 104 exceeds the width of the gap 47. The resulting interference between the flat portion 104 and ears 46 prevents any forward movement of the CPA 82, maintaining it in the retracted position 110. For the CPA 82 to move forward to the locked position 112, the finger 96 must be deflected such that the flat portion 104 is no longer at the same elevation as the ears 46.

If the CPA 82 starts in the retracted position 110, the plug housing 12 and header 18 may be mated as described above. After mating, the deflectable latch beam 36 is once again substantially horizontal. Also, the header rail 68 and latch rail 40 are aligned such that the CPA 82 may slidably engage both simultaneously. As shown in FIG. 18, the header bump 74 and the embossment 102 of the finger 96 are configured such that there would be an interference 114 between the header bump 74 and the embossment 102 when the finger 96 is not deflected. However, the CPA 82 has not approached the header bump 74 solely from the horizontal. Rather, the CPA 82 was on the front portion 37 of the deflectable latch beam 36. Consequently, the CPA 82 articulated with the front portion 37 as the latch engaging surface 38 traversed the latch mating element 60 as described above. The embossment 102 remains clear of the header bump 74 until the deflectable latch beam 36 snaps into place and returns to horizontal. As the deflectable latch beam 36 begins to snap into place with the CPA 82 in place on the latch rail 40, the embossment "lands" on the header bump 74. As the deflectable latch beam 36 completes its return to a substantially horizontal position, the finger 96 is deflected in a relatively upward direction with respect to the deflectable latch beam 36 by the interference 114 with the embossment 74.

With the finger 96 thus deflected, the flat portion 104 is now at a different elevation than the ears 46, and the CPA 82 may be advanced from the retracted position 110 to its locked position 112. Because the latch rail 40 and the header rail 68 are aligned, the rail surface 88 of the CPA 82 is able to slidably engage the header rail 68 while maintaining slidable engagement with the latch rail 40 as the CPA advances toward the locked position 112. Thus, with the rails aligned and the flat portion 104 clear of the ears 46, the CPA 82 may be moved into the locked position 112. As the CPA 82 advances, the embossment 102 will eventually clear the header bump 74. As shown in FIG. 19, the finger 96 will then return to a substantially horizontal position, and the embossment 102 will cooperate with the header bump 74 to help maintain the CPA 82 in the locked position 112. Preferably, the stop 72 of the header rail 68 cooperates with the face 94 of the rail surface 88 to prevent the CPA 82 from advancing too far forward.

The CPA 82 can be removed from the locked position 112 by an external force (such as that provided by an operator's thumb) urging the CPA 82 toward the rear end 16 of the plug housing 12. As the CPA 82 moves toward the rear end 16, the embossment 102 will encounter the rear ramped portion 80 of the header bump 74. This contact will deflect the front of the finger 96 upward. When the CPA 82 is back in the retracted position 110, the finger 96 will remain deflected, with the embossment 102 resting on the header bump 74. As the plug housing 12 and header 18 are separated, the finger will return to a substantially horizontal position, and the flat portion 104 will once again be constrained by the ears 46 from moving to the locked position 112 while the plug housing 12 and header 18 are not mated.

Unfortunately, an unintended external force may deflect the finger 96 and move the CPA 82 into the locked position 112 when the plug housing 12 and header 18 are not mated. This can result in an improper mating when the plug housing 12 and header 18 are urged together, with the plug housing 12 and header 18 subject to the risk of unintended separation. Additionally, the operator may be forced to expend time returning the CPA 82 to the retracted position 110. These problems may be avoided by a sealed electrical connector assembly that automatically returns the CPA to the retracted position upon the urging of the plug housing 12 and header 18 together.

As described more fully above, the front portion 37 of the deflectable latch arm 36 is deflected upward as the plug housing 12 and header 18 are urged together. When the CPA 82 is in the locked position 112, it resides toward the front portion 37 of the deflectable latch beam 36. From before, the latch rail 40 and header rail 68 are aligned when the deflectable latch arm 36 is substantially horizontal. However, they are not aligned when the deflectable latch arm 36 is deflected with its front portion 37 upward.

In the illustrated embodiment, the rail surface 88, latch engaging surface 38, and ramped surface 62 are configured such that the face 94 of the rail surface 88 contacts the header rail 68 when the CPA 82 is in the locked position 112 and the deflectable latch beam 36 is deflected upward as the plug housing 12 and header are urged toward each other. This interference urges the CPA 82 back toward the rear end 16 of the plug housing 12 as the plug housing 12 and header 18 are further urged toward each other. As the CPA 82 is thus urged backward, the embossment 102 encounters resistance that results in the finger 96 being deflected upward. The CPA 82 is then free to return to the retracted position 110, and is forced into the retracted position 110 upon further urging of the plug housing 12 and header 18 together. Thus, the CPA 82 is automatically returned to the retracted position 110 during the mating of the plug housing 12 and the header 18, thereby assuring proper mating as well as saving the operator time. Once the mating is complete, the CPA 82 may be advanced to the locked position 112 to assure that the plug housing 12 and header 18 remain mated.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A sealed electrical connector assembly, said assembly comprising:

a connector position assurance device (CPA) including at least one CPA support rail and a CPA latch finger;

a plug housing having a body section with a mating interface on one end thereof, said mating interface retaining a plurality of plug contacts, said plug housing further including a shroud extending about at least a portion of said body section, said shroud being spaced apart from said body section by a gap, said mating interface extending outwardly from and beyond said shroud;

a header having a base retaining a plurality of header contacts adapted to electrically engage said plug contacts, said header having walls defining a plug receptacle adapted for receiving said mating interface, said walls being received in said gap between said shroud and said body section;

a seal mounted to one of said plug housing and header, said seal forming a hermetic seal between said plug housing and header when said plug housing and header are fully mated with one another; and a CPA retention assembly mounted to at least one of said plug housing and said header, said CPA being slidably mounted to said CPA retention assembly and movable between a retracted position and a locked position, said CPA permitting engagement and disengagement of said header and plug housing when in said retracted position, said CPA preventing engagement and disengagement of said header and plug housing when in said locked position.

2. The sealed electrical connector assembly of claim 1, wherein said CPA further comprises at least one rail support having a groove therein, and said CPA latch assembly comprises at least one rail slidably received in said groove to guide said CPA between said retracted and locked positions.

3. The sealed electrical connector assembly of claim 1, wherein said shroud surrounds a perimeter of said plug housing to define a peripheral gap about said seal, said gap accepts top, bottom and sidewalls of said header to form a hermetic seal between said body section and said header.

4. The sealed electrical connector assembly of claim 1, wherein said header includes a CPA reset embossment on one of said walls, said CPA reset embossment engaging, and resetting to said retracted position, said CPA when said CPA is in said locked position before said plug housing and header are fully mated with one another.

5. The sealed electrical connector assembly of claim 1, wherein said plug housing comprises top, bottom and sidewalls defining said mating interface of said body section, and wherein said header comprises top, bottom and sidewalls defining said opening, said walls of said plug housing and header forming a hermetic contact with said seal when said header and plug housing are fully mated.

6. The sealed electrical connector assembly of claim 1, wherein said CPA retention assembly is mounted on said shroud.

7. The sealed electrical connector assembly of claim 1, further comprising a deflectable latch beam mounted at an intermediate point along said latch beam to said plug housing, said header including a latch mating element engaging one end of said latch beam when said plug housing and header are fully mated.

8. The sealed electrical connector assembly of claim 1, said seal being mounted to a perimeter of said body section, said walls of said header forming a sealed interface with said body section of said plug housing.

9. The sealed electrical connector assembly of claim 1, wherein said CPA retention assembly includes a header rail and a latch rail, said header rail being mounted to a wall of said header and said latch rail being mounted to said shroud, said header rail and latch rail aligning when said plug housing and header are fully mated.

10. The sealed electrical connector assembly of claim 1, wherein said CPA retention assembly includes header and latch rails mounted on said header and plug housing, said CPA being movable from a retracted position on one of said header and latch rails to a locked position on an opposite of said header and latch rails when said plug housing and header are fully mated.

11. The sealed electrical connector assembly of claim 1, wherein said CPA retention assembly includes a header rail adapted to slidably received said CPA and a ramped projection on said header, said ramped projection causing said CPA to become misaligned said header rail when said CPA is prematurely moved to the locking position before a mating operation of said plug housing and header thereby causing a mechanical interference between said header rail and said CPA.

12. The sealed electrical connector assembly of claim 1, further comprising a latch assembly to securely join said plug housing and header, said latch assembly comprising a finger stop.

13. The sealed electrical connector assembly of claim 12, wherein said finger stop comprises a channel and ears, said finger stop comprising an embossment configured such that said finger must be deflected in order to move said CPA from said retracted position to said locked position.

14. The sealed electrical connector housing assembly of claim 13, wherein said embossment further comprises a front ramped portion, a rear ramped portion, and a flat portion, said ears defining a gap width, said flat portion of said embossment defining a flat portion width, said flat portion being substantially aligned with said ears when said finger is substantially horizontal, and said flat portion width being greater than said gap width, whereby said finger must be deflected in order to move from said retracted position to said locked position.

15. The sealed electrical connector assembly of claim 1, wherein said header further comprises a header bump mounted to one of said walls, said header bump including front and rear ramped surfaces and a flat upper surface, said header bump engaging a latch mounted to said plug housing when mated.

16. An electrical connector comprising:

a connector position assurance device (CPA) having a CPA guideway and a CPA retention lever;

a first connector housing having a first connector interface containing at least one contact;

a second connector housing having a second connector interface containing at least one contact, said contacts of said first and second connector interfaces being mated with one another;

a shroud mounted to said first connector housing and arranged to surround said second connector housing when said first and second connector housings are fully mated, said first connector interface extending outwardly from and beyond said shroud, said first connector interface being received within said second connector housing when said first and second connector housings are fully mated;

a latch assembly having a first latch guideway adapted to slidably join said CPA guideway to permit said CPA to be moved to a locked position and having a latch engaging surface;

a latch mating element located on one of said first and second connector housings, said latch mating element securely engaging said latch engaging surface when said first and second connector housings are fully mated, said latch mating element including a second latch guideway adapted to slidably join said CPA guideway to retain said CPA when in a retracted position; and a seal mounted to one of said first and second connector housings to form a hermetic seal between said first and second connector housings when fully mated.

17. The electrical connector of claim 16, wherein said first and second latch guideways includes rails and said CPA guideway includes grooves that accept said rails.

18. The electrical connector of claim 16, wherein said first and second connector housings each include top, bottom and sidewalls defining said first and second connector interfaces that are hermetically sealed to one another by said seal when fully mated.

19. The electrical connector of claim 16, wherein said latch assembly is formed on a shroud surrounding said first connector housing.

20. The electrical connector of claim 16, wherein said latch assembly comprises a deflectable latch beam that is deflected by said latch mating element while said first and second connector housings are joined, thereby preventing said CPA from being moved to said locked position prematurely.

21. The electrical connector of claim 16, wherein said latch assembly includes a header rail and a latch rail, said header rail being mounted to said first connector housing and said latch rail being mounted to said second connector housing, said header rail and latch rail aligning when said first and second connector housings are fully mated.

22. The electrical connector of claim 16, wherein said latch assembly includes a first rail adapted to slidably receive said CPA and a ramped projection causing said CPA to become misaligned with said header rail when said CPA is prematurely moved to said locked position before a mating operation of said first and second connector housings thereby causing a mechanical interference between said rail and CPA.

23. The electrical connector of claim 16, wherein said latch assembly includes a finger stop comprising a channel and ears, said finger stop comprising an embossment configured such that said finger stop must be deflected in order to move said CPA from said retracted position to said locked position.

24. A sealed electrical connector housing assembly, said assembly comprising:

a connector position assurance device (CPA);

a first housing having a shroud, said first housing defining a mating interface extending outwardly from and beyond said shroud;

a second housing defining an opening receiving said mating interface of said first housing;

a latch located on one of said first or second housings;

a latch mating element, on another of said first and second housings, positioned to securely engage said latch when said first and second housings are fully mated with one another;

a seal mounted on one of the first and second housings wherein said CPA is slidably mounted to one of said first and second housings to be movable between a retracted position and a locked position, said assembly being configured such that when said first and second housings are attempted to be mated with said CPA in said locked position, said CPA will be forced back to said retracted position.

25. The CPA of claim 24, wherein said latch is located on said shroud.

26. The CPA of claim 24, wherein said latch comprises a deflectable latch beam.

27. The CPA of claim 24, wherein a ramped surface on said latch mating element, said housing rail, and said CPA are configured such that when said plug housing assembly and said header are attempted to be mated with said CPA in said locked position, there is a mechanical interference between said housing rail and said CPA.

28. The CPA of claim 24, wherein said latch includes a finger stop comprises a channel and ears, and said finger comprises an embossment configured such that said finger must be deflected in order to move said CPA from said retracted position to said locked position.

29. The CPA of claim 28, wherein said embossment further comprises a front ramped portion, a rear ramped portion, and a flat portion, said ears defining a gap width, said flat portion of said embossment defining a flat portion width, said flat portion being substantially aligned with said ears when said finger is substantially horizontal, and said flat portion width being greater than said gap width, whereby said finger must be deflected in order to move from said retracted position to said locked position.

30. A sealed electrical connector assembly, comprising:

a connector position assurance device (CPA) including at least one CPA support rail and a CPA latch finger;

a plug housing having a body section with a mating interface on one end thereof, said mating interface retaining a plurality of plug contacts, said plug housing further including a shroud extending about at least a portion of said body section, said shroud being spaced apart from said body section by a gap, said mating interface extending outwardly from said shroud;

a header having a base retaining a plurality of header contacts adapted to electrically engage said plug contacts, said header having walls defining a plug receptacle adapted for receiving said mating interface, said walls being received in said gap between said shroud and said body section;

a seal mounted to one of said plug housing and header, said seal forming a hermetic seal between said plug housing and header when said plug housing and header are fully mated with one another;

a CPA retention assembly mounted to at least one of said plug housing and said header, said CPA being slidably mounted to said CPA retention assembly and movable between a retracted position and a locked position, said CPA permitting engagement and disengagement of said header and plug housing when in said retracted position, said CPA preventing engagement and disengagement of said header and plug housing when in said locked position; and a latch assembly to securely join said plug housing and header, said latch assembly comprising a finger stop, said finger stop comprising a channel and ears, at least one of said latch finger and said finger stop comprising an embossment configured such that said finger must be deflected in order to move said CPA from said retracted position to said locked position, said embossment comprising a front ramped portion, a rear ramped portion, and a flat portion, said ears defining a gap width, said flat portion of said embossment defining a flat portion width, said flat portion being substantially aligned with said ears when said finger is substantially horizontal, and said flat portion width being greater than said gap width, whereby said finger must be deflected in order to move from said retracted position to said locked position.

31. A sealed electrical connector assembly, comprising:

a connector position assurance device (CPA) including at least one CPA support rail and a CPA latch finger;

a plug housing;

a header matable with said plug housing;

a latch assembly to securely join said plug housing and said header, said latch assembly comprising a finger stop, said finger stop comprising a channel and ears, at least one of said finger and said finger stop comprising an embossment configured such that said finger stop must be deflected in order to move said CPA from a retracted position to a locked position, said embossment comprising a front ramped portion, a rear ramped portion, and a flat portion, said ears defining a gap width, said flat portion of said embossment defining a flat portion width, said flat portion being substantially aligned with said ears when said finger is substantially horizontal, and said flat portion width being greater than said gap width, whereby said finger must be deflected in order to moved from said retracted position to said locked position.

* * * * *